US009530634B2

(12) United States Patent
Rolff

(10) Patent No.: US 9,530,634 B2
(45) Date of Patent: Dec. 27, 2016

(54) DEVICE FOR SUPPLYING VOLTAGE TO THE CATHODE OF A MASS SPECTROMETER

(71) Applicant: Inficon GmbH, Cologne (DE)

(72) Inventor: Norbert Rolff, Horrem (DE)

(73) Assignee: Inficon GmbH, Cologne (DE)

( * ) Notice: Subject to any disclaimer, the term of this patent is extended or adjusted under 35 U.S.C. 154(b) by 0 days.

(21) Appl. No.: 14/381,171

(22) PCT Filed: Feb. 22, 2013

(86) PCT No.: PCT/EP2013/053550

§ 371 (c)(1),
(2) Date: Aug. 26, 2014

(87) PCT Pub. No.: WO2013/127701

PCT Pub. Date: Sep. 6, 2013

(65) Prior Publication Data

US 2015/0028743 A1 Jan. 29, 2015

(30) Foreign Application Priority Data

Feb. 29, 2012 (DE) ..... 10 2012 203 141

(51) Int. Cl.
*H01J 49/00* (2006.01)
*H01J 49/02* (2006.01)
*H01J 49/10* (2006.01)

(52) U.S. Cl.
CPC ..... *H01J 49/022* (2013.01); *H01J 49/10* (2013.01)

(58) Field of Classification Search
CPC .... H01J 49/022; H01J 49/10; H02M 3/33592; H02M 7/217
See application file for complete search history.

(56) References Cited

U.S. PATENT DOCUMENTS 2,587,555 A * 2/1952 Weiss ..... H01J 49/022 250/300
3,869,659 A * 3/1975 Doong ..... H01J 49/022 324/459
5,565,740 A 10/1996 Hiramatsu et al.
5,625,541 A 4/1997 Rozman
6,064,580 A * 5/2000 Watanabe ..... H02M 3/33592 363/127

(Continued)

FOREIGN PATENT DOCUMENTS

DE 40 17 859 A1 12/1991
DE 699 01 918 T2 2/2003

(Continued)

*Primary Examiner* — Thai Pham
(74) *Attorney, Agent, or Firm* — Craig Metcalf; Kirton McConkie

(57) ABSTRACT

A simplified device for voltage supply of the cathode of a mass spectrometer comprises a push-pull transformer, wherein, apart from the normal rectifier diodes (7, 9), a controlled rectifier (8, 10) is provided. The gate of the first transistor (8) is connected to the second output (30), and the gate of the second transistor (10) is connected to the first output (32) of the transformer. A voltage supply device, consisting of at least one voltage multiplier, is connected via capacitors (13, 14, 15) to the output of the transformer and feeds, amongst others, the emission current measurement device.

9 Claims, 2 Drawing Sheets

(56) References Cited

U.S. PATENT DOCUMENTS

Figure 1:
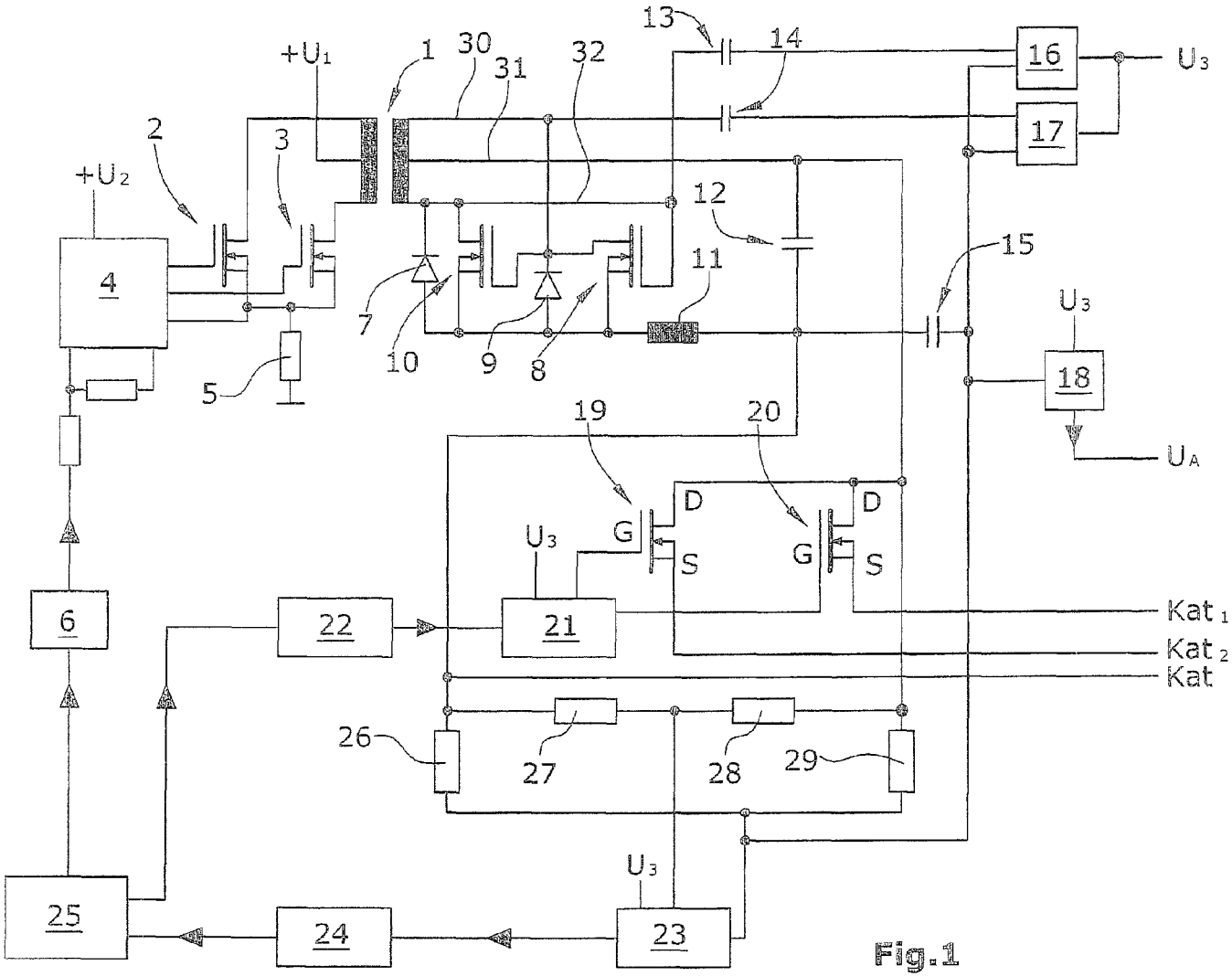

| | | | | |
|---|---|---|---|---|
| 6,784,867 | B1 | 8/2004 | Chang | |
| 2010/0046264 | A1* | 2/2010 | Ho | H02M 7/219<br>363/127 |

FOREIGN PATENT DOCUMENTS

| | | | |
|---|---|---|---|
| JP | 2003 079142 | A | 3/2003 |
| JP | 2005 5210899 | A | 8/2005 |
| JP | 2007 318999 | A | 12/2007 |

* cited by examiner

DEVICE FOR SUPPLYING VOLTAGE TO THE CATHODE OF A MASS SPECTROMETER

This application is a National Stage of International Application No. PCT/EP2013/053550, filed Feb. 22, 2013, and entitled DEVICE FOR SUPPLYING VOLTAGE TO THE CATHODE OF A MASS SPECTROMETER, which claims the benefit of DE 10 2012 203 141.3, filed Feb. 29, 2012. This application claims priority to and incorporates herein by reference the above-referenced applications in their entirety.

The invention relates to a device for voltage supply of an ion source of a mass spectrometer, and particularly for voltage supply of the mass spectrometer cathode.

Mass spectrometers are used for analysis of gases and find application in leak detection devices, inter alia. By means of an electric field, the electrons issuing from the hot cathode are accelerated. In the process, an electrode current is generated which, by means of the electrodes, will ionize the to-be-tested substance in the gaseous phase and will be fed to an analyzer. This electric field is generated between a cathode and an anode. For voltage supply to the cathode of a mass spectrometer, a predetermined emission current has to be generated reliably and with minimum interfering components, which is performed by varying the heating voltage of the cathode that is used as an actuator.

It is an object of the invention to provide a device for voltage supply of the cathode of a mass spectrometer, which device shall have a small number of component parts and low power dissipation.

In accordance with the invention, the above object is achieved by a device with the features defined in claim 1.

It is thus provided that, in a switching power supply, a transformer has a primary-side input voltage applied to it. On the secondary side, the transformer is provided with two output connectors and one output-side intermediate connector. To said two output connectors of the transformer, mutually opposite output voltages are applied, i.e. output voltages which are phase-shifted by 180° relative to each other. If a positive output voltage is applied to the first output connector, the same output voltage, but with reversed sign, is applied to the second output connector. Each of the two output connectors of the transformer is connected directly to a diode. For increased efficiency, use is made of transistors arranged in parallel to the diodes in a manner corresponding to a controlled rectifier, wherein, in case of two n-channel transistors, the cathode of one diode is connected directly to the first transformer output and the cathode of the second diode is connected directly to the second transformer output. In case of p-channel transistors, in a corresponding way, the anode of one diode is connected to the first transformer output and the anode of the other diode is connected to the second transformer output. In other words, this is to say that mutually corresponding connectors of the two diodes are respectively connected directly to different outputs of the transformer.

In each of the two diodes, exactly one transistor is connected in parallel, wherein, according to the invention, the gate of one transistor is connected directly to the first output connector and the gate of the second transistor is connected directly to the other output connector of the transformer.

Said diodes serve for rectifying the transformer output voltages, wherein the transistors connected in parallel to the diodes are effective to improve the efficiency of the circuit.

Preferably, for this purpose, the drain connector of one transistor is connected directly to the first transformer output, and the drain connector of the other transistor is connected directly to the second transformer output. The source connectors of the two transistors can be connected to each other and be directly coupled to the connectors which are arranged opposite to the transformer and are not directly connected to the transformer. Thus, in case of p-channel transistors, the source connectors are coupled to the two cathodes of the diodes, and, in case of n-channel transistors, they are coupled to the two anodes of the diodes. Preferably, the transistors are field-effect transistors of the p-channel type or the n-channel type.

Preferably, a smoothing capacitor and a choke coil form a low pass between the intermediate connector of the transformer and the source connectors of the transistors. In contrast to the described variant as a push-pull transformer, the circuit can also be designed as a single-ended flow transformer, requiring respectively only one transistor and one diode.

According to one embodiment, the voltage supply device serves for driving two cathodes, which is effected in that two transistors will alternately drive exactly one of the two cathode output connectors. A conventionally used relay for alternate control of the cathode connectors can then be omitted. Further, the driving by use of the transistors will then be performed more reliable and faster than would be possible by use of conventional switching relays.

Preferably, with the aid of at least one voltage multiplier, a further direct current (DC) voltage is generated from at least one of the output voltages applied to the two transformer outputs. To each of the two transformer outputs, there can herein be assigned exactly one voltage multiplier which can be connected, via a separation capacitor, to the respective output. The DC voltage can serve.

a) as a supply for generating the electron energy (anode voltage) for the mass spectrometer,
b) for generating a supply voltage for the transistors driving the two cathode connectors, and/or
c) for power supply to a measurement circuit for measuring and/or controlling the emission current.

The emission current is the current flowing within the ion source from the anode to the respective switched-on cathode, wherein the electron energy is given by the voltage difference between anode and cathode. Preferably, the emission current is transmitted with the aid of the pulse width modulation.

An exemplary embodiment of the invention will be explained in greater detail hereunder with reference to the Figures of the drawing.

Figure 2:
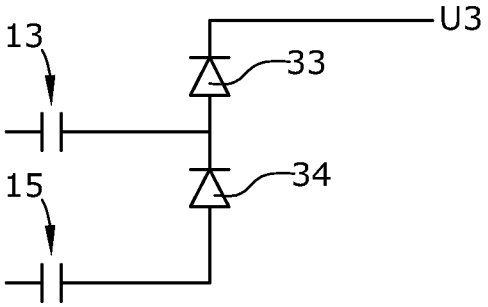

FIG. 1 shows a schematic diagram of the voltage supply device designed as a push-pull transformer, and FIG. 2 is a view of a detail of FIG. 1.

A transformer 1 is provided, on its primary side and its secondary side, with respectively three connectors. To one of the primary connectors, the input voltage $U_1$ for the transformer is applied. To the first output connector 32 and the second output connector 30, there are applied mutually phase-shifted, i.e. mutually opposite transformer output voltages. The third secondary connector is designed as an output-side intermediate connector 31. Hereunder, the first output connector 32 will be referred to as a negative output and the second output connector 30 will be referred to as a positive output, i.e. there will be observed only one phase of the obtained output voltages.

Said negative output 32 is connected to the cathode of a diode 7. Said positive output 30 is connected to the cathode of a diode 9. The anodes of the two diodes 7, 9 are connected to each other.

Connected in parallel to each of the two diodes 7, 9 is a transistor 8, 10 in the form of an n-channel field effect transistor. In this arrangement, the source connectors of the two transistors 8, 10 are respectively connected to the anodes of the two diodes. The drain connector of the first transistor 8 is connected to the negative output 32, and the drain connector of the second transistor 10 is connected to the positive output 30. The gate connector of the first transistor 8 is connected to the drain connector of the second transistor 10 and to the positive output 30. The gate connector of the second transistor 10 is connected to the drain connector of the first transistor 8 and to the negative output 32. Thus, at this time, transistor 8 is in the conductive state while transistor 10 is blocked.

In case of p-channel transistors 8, 10, it would merely be required to reverse the direction of the diodes so that the cathodes of the two diodes 7, 9 are connected to each other and the anodes of the diodes are connected to respective different outputs 30, 32 of transformer 1.

According to the invention, the supply voltage for detection, control and generation of the electron energy for the anode-cathode emission will be generated from the same transformer coil of transformer 1. If higher cathode heating currents exist, the rectification is supported by a controlled rectifier 8, 10 which, in the push-pull transformer, is controlled directly from the transformer output voltage of the respective other path. The controlled rectifier 8 which rectifies the output 32 is directly controlled via the transformer output 30. During those times when the transformer output voltage is close to zero volts, the current will flow through the choke coil 11 connected to the source connectors of the two transistors 8, 10 and through the diodes 7, 9.

Since the voltages at the transformer output which are adequate for the cathode are of often low, it is advisable to bring the voltage to the desired value U3 with the aid of a voltage multiplier 16, 17. For this purpose, the invention provides that respectively one voltage multiplier 16, 17 is connected, via a respective separation capacitor 13, 14, to the positive output 30 and to the negative output 32 of transformer 1. FIG. 2 is a schematic view of a simple voltage multiplier formed of the diodes 33 and 34. At the outputs of the voltage multipliers 16, 17, the DC voltage $U_3$ is picked up which can be used e.g. for supplying a voltage generation device 18 provided for generating the anode voltage $U_A$. By way of alternative or additionally, the DC voltage $U_3$ can be used to feed a voltage supply device 21 which, via the optocoupler 22, delivers information for the gate voltages for two transistors 19, 20 which will alternately drive two separate cathode connectors $Kat_1$, $Kat_2$.

In the above arrangement, the drain connectors of the two transistors 19, 20 are respectively connected to the intermediate connector 31 of the transformer which, in case of n-channel transistors, is the positive pole of the cathode supply voltage. The gate connectors of the transistors 19, 20 are respectively connected to the voltage supply device 21. The source connector of one transistor 19 is connected to the second cathode connector Kat2, and the source connector of transistor 20 is connected to the first cathode connector Kati. The cathode connectors Kati, Kat2 can have respectively one cathode connected to them, the opposite pole of said cathode being connected to the common cathode connector Kat. Switching of the cathodes can be performed in a simple manner through the DC voltage heating by use of a respective transistor 19, 20. Particularly, also in case of a plurality of cathode connectors, i.e. more than two cathode connectors, the driving of the cathode connectors can be carried out by respectively one transistor.

The emission current will flow, within the ion source, from the connector for the anode voltage $U_A$ to the connectors of the presently switched-on cathode $Kat_1$ and respectively $Kat_2$ and to the common cathode connector. The average cathode potential is mapped by means of the resistors 27, 28 inclusive of the voltage drop at the resistors 26 and 29 caused by the emission current. Around the emission current on the mass potential, on which the signal evaluation unit 25—preferably being a processor component—is normally kept, the emission current causing said voltage drop at the resistors 26, 29 will be formed by conversion into a PWM signal within the pulse width modulation converter 23. The PWM signal will be transmitted via an octocoupler 24 to the mass-related signal evaluation unit 25. Therein, using a microprocessor, the PWM signal will be converted into numerical values which will then be proportionate to the emission current. In this manner, with the aid of the obtained numerical values and a software, the emission current can be controlled.

The control variable is the duty ratio of the switching power supply 4 and can be generated directly from the processor. In the illustrated embodiment, the control variable is generated via an analog output which is formed with the aid of a digital/analog converter 6 and a switching power supply IC ("integrated circuit") 4. In this regard, use can be made of the current limitation realized in the switching power supply IC. For this purpose, the resistor 5 is used as a current limitation resistor. Generating the electron energy requires only a step-up converter 18 which normally generates a voltage of about 70 to 100 V from the isolated supply voltage $U_3$.

The voltage multipliers 16, 17, consisting at least of respectively two rectifiers, are fed by capacitive coupling to the transformer consisting of the capacitors 13, 14, 15, and they allow for a connection which is insulated for direct currents, as shown in FIG. 2. The direct-voltage insulation of the voltage supply makes it possible that the emission current which—at the power output of the rectifier consisting of the component parts 7, 8, 9 and 10—is flowing into the active cathode, can be evaluated without faults. Respectively one voltage multiplier is connected to preferably both transformer outputs 30, 32, thereby effecting an increase of the current carrying capacity and a decrease of the ripple. Further, peaks in the transformers are reduced which otherwise could destroy the active rectifier.

The invention claimed is:

1. A device for voltage supply of the cathode of a mass spectrometer, said device comprising a transformer supplied by an input voltage, said transformer having at least one first output and a second output and an output-side intermediate connector, at least two diodes being connected, via their mutually corresponding connectors, i.e. the cathodes or the anodes, to different ones of the outputs of the transformer, the connector of the first diode being connected to the first output and the connector of the second diode being connected to the second output, and there being provided, for each diode, a first and respectively second transistor connected parallel to the respective diode, and a source connector of each transistor being connected to that connector of the corresponding diode which is arranged opposite to the transformer, wherein a gate of the first transistor is connected to the second output and a gate of the second transistor is connected to the first output of the transformer, wherein a direct current (DC) voltage is generated by applying at least one voltage multiplier to an output voltage of one or more of the following: the first output and the second output of the transformer.

2. The device according to claim 1, wherein a drain connector of the first transistor is connected to the first output and a drain connector of the second transistor is connected to the second output of the transformer.

3. The device according to claim 1, wherein a low-pass consisting of a smoothing capacitor and a choke coil is provided between the output-side intermediate connector of the transformer and the source connectors of the transistors.

4. The device according to claim 1, wherein the device, for feeding two cathodes, is provided with a respective output for each of said two cathodes, wherein a third and a fourth transistors for alternately driving the two cathode connectors are connected to the transformer.

5. The device according to claim 4, wherein each cathode connector is connected to the source connector of at least one of the third or fourth transistors, wherein one of the third or fourth transistors drives the associated cathode connector exactly when the transistor voltage applied to the respective gate connector exceeds the cathode voltage applied to the source connector.

6. The device according to claim 1, wherein said at least one voltage multiplier, consisting of at least two rectifiers, is connected via a separation capacitor to one of the two output connectors of the transformer, thus providing an active path, and is connected via a capacitor to the connectors of the diodes which are arranged opposite to the transformer, thus providing a reference path.

7. The device according to claim 1, wherein said DC voltage serves for one or more of the following: feeding a voltage supply device generating the gate voltage of a third and fourth transistor, feeding a voltage supply device generating the anode voltage of the mass spectrometer, feeding a measurement circuit for measuring the emission current of the respective activated cathode, wherein the third and fourth transistors for alternately driving the two cathode connectors are connected to the transformer.

8. The device according to claim 1, wherein a measurement circuit for measuring the emission current of the respective activated cathode is provided in the form of a pulse width modulator.

9. The device according to claim 8, wherein the emission current is decreasing across two first resistors which are connected in series between the intermediate connector and those connectors of the two diodes which are arranged opposite to the transformer, and is provided to the measurement circuit via two resistors connected in series to each other and in parallel to the first resistors.

* * * * *